United States Patent [19]

Barditch

[11] Patent Number: 4,558,467

[45] Date of Patent: Dec. 17, 1985

[54] GASTIGHT SEALS FOR RUBBER SUITS

[75] Inventor: Irving F. Barditch, Baltimore, Md.

[73] Assignee: The United States of America as represented by the Secretary of the Army, Washington, D.C.

[21] Appl. No.: 578,330

[22] Filed: Feb. 9, 1984

[51] Int. Cl.[4] ..... A63C 11/04

[52] U.S. Cl. ..... 2/2.1 R; 2/270

[58] Field of Search ..... 2/2.1 R, 2.1 A, 275, 2/70, 162, 270; 128/201.27; 405/186; 285/97, 260; 24/578, 580, 618

[56] References Cited

U.S. PATENT DOCUMENTS 3,000,014 9/1961 White ..... 2/270

3,262,129 7/1966 Castle ..... 2/270

4,365,351 12/1982 Doershuk et al. ..... 2/2.1 R

*Primary Examiner*—Werner H. Schroeder

*Assistant Examiner*—J. L. Kravitz

*Attorney, Agent, or Firm*—Anthony T. Lane; Robert P. Gibson; Michael C. Sachs

[57] ABSTRACT

The present invention discloses a gastight seal for rubber suits. It includes rubber bladders containing viscid material and has annular rings attached to a pleated bellows-like section of a main body of the rubber suit. A strap is used to actuate the rubber bladders which interlock the annular rings which join two sections of the main body of the rubber suit. Thus, an integral gastight seal on the rubber suit section is achieved.

2 Claims, 3 Drawing Figures

GASTIGHT SEALS FOR RUBBER SUITS

GOVERNMENTAL INTEREST

The invention described herein may be manufactured, used and licensed by or for the Government for Governmental purposes without the payment to me of any royalties thereon.

BACKGROUND OF THE INVENTION

The present invention relates to a field of the art dealing with gastight sealing or joining two sections of rubber suits or two members made of same rubber-like material. Rubber suit sections are normally sealed together with tape. An integral seal on the suit section is obviously more desirable.

The basic shortcoming in prior art devices is related to an absence of a gastight seal which can make perfect joint of two rubber sections. The prior art sealing devices are not reliable and lack flexibility and functionability. They have usually comprised overlapping sections held together by tape or other expedients. There is also a longitudinal stress on these junctions.

Accordingly, the present invention is intended as a solution to the problems in presently available sealing devices and methods as described hereinbefore.

SUMMARY OF THE INVENTION

The present invention relates to gastight seals for rubber suits. The basic concept is that a rubber bladder having liquid or semi-liquid material such as grease which under pressure become rigid and fixed in shape. The seal includes a rubber bladder having annular protuberant rings of mushroom-like cross-section which can interlock. A pleated bellows-like section above and below the main body of the junction means is attached to the remainder of the rubber suit. The two mating sections of the rubber suit, for example: gloves and the main body of the suit, or boots and the main body of the suit are integrally attached under pressure in the interlocking of the annular rings of two separate rubber bladders.

It is the object of the present invention to provide a simplified and reliable integral gastight seal for rubber suits.

It is another object of the present invention to provide an improvement over the prior art method of using a tape to seal rubber suit sections, or velcro strips or zippers.

DESCRIPTION OF THE PREFERRED EMBODIMENTS

A general understanding of the present invention may be obtained with respect to the drawings.

Figure 1:
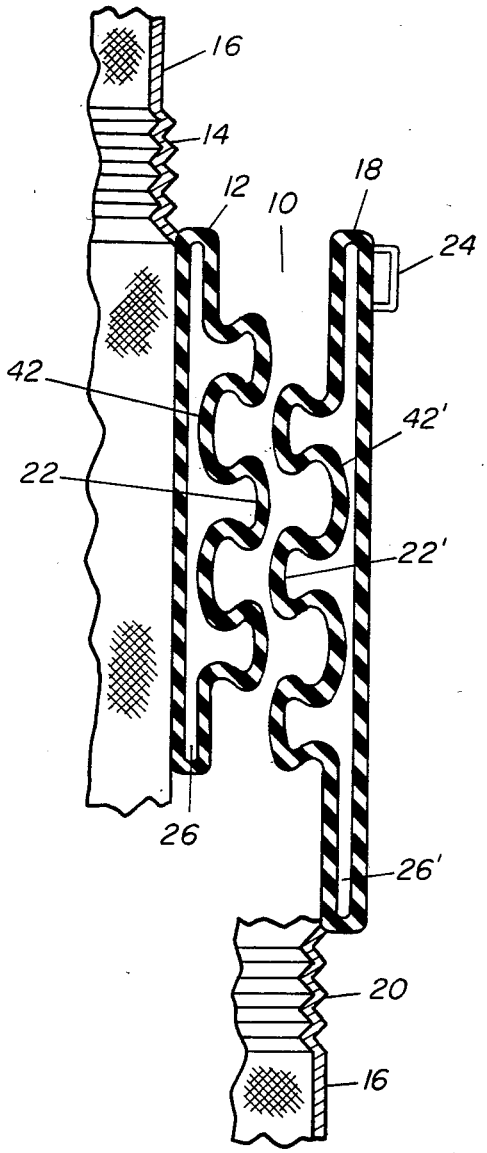
FIG. 1 represents a simplified cross-sectional view of a gastight seal of the present invention.

FIG. 1 shows a gastight seal 10 comprising a first rubber bladder 12 attached to a first pleated bellows-like section 14 of a main body 16 of rubber suit. Similarly, a second rubber bladder 18 is attached to a second pleated bellows-like section 20 of a main body 16 of the rubber suit. The bladders 12 and 18 also include a plurality of annular mushroom-shaped protuberant ribs 22 which interlock or fit into respective valleys, 42, of the opposite bladder for connection, under pressure. An outer garment for connection has a female, inner, rib and valley structure (on bladder 18 for instance), whereas an inner garment to be tucked thereinto, and be sealed, has a male, outer set of ribs and valleys around it (on bladder 12 for instance).

Figure 2B:
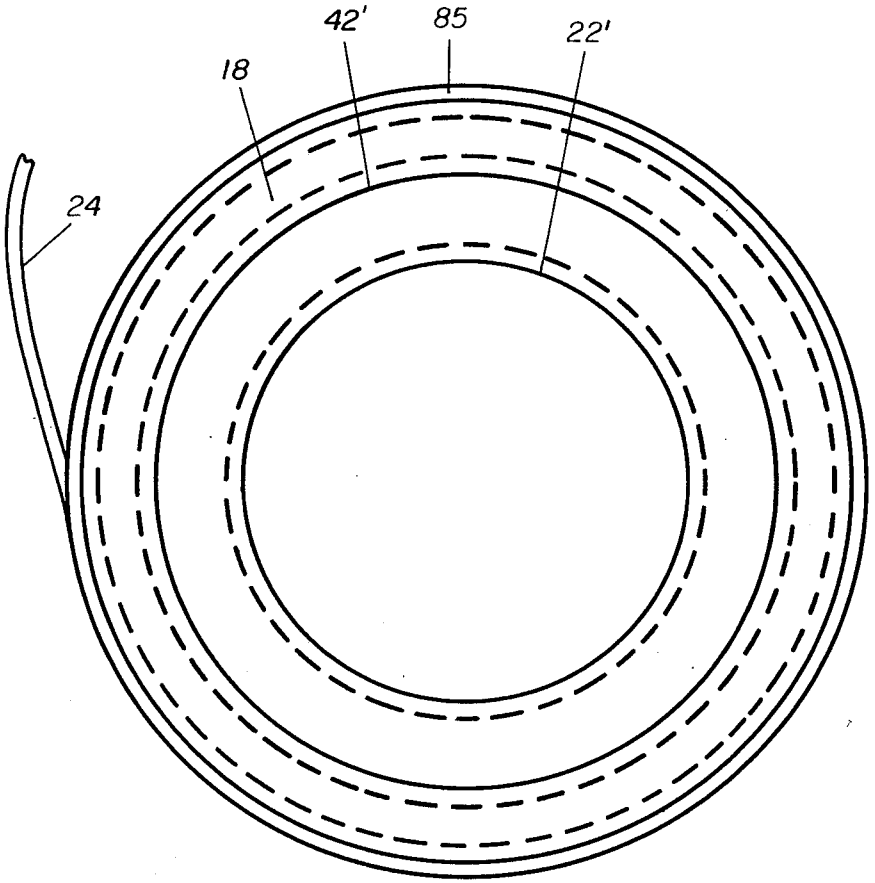
FIGS. 2A and 2B represent, respectively, top views of a male and mating female section of a gastight seal according to this invention.
Figure 2A:
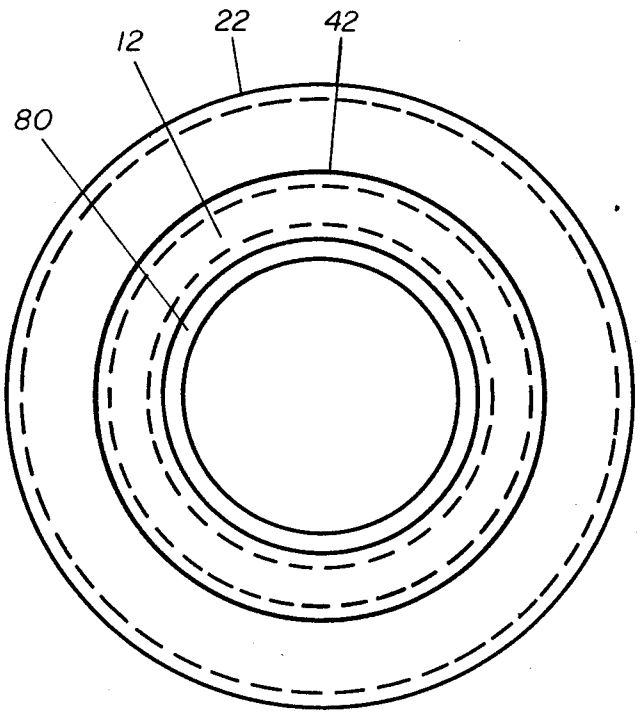

It should be understood that the bladders are actually part of the respective rubber suit halves or sections to be joined; they are not merely attached thereto. The continuity of a male bladder, e.g., with the rest of the suit is represented conceptually at FIG. 2A as "80" and for FIG. 2B it is 85, which means continuity with the suit. In the case shown in FIG. 1 for example, this would be bellows 14, which itself is part and parcel of the main suit half of 16. In FIG. 2B it could be bellows 20, or no bellows, e.g., or the bladder could be attached to the inside diameter of the bellows 20 and suit 16, rather than to the outside diameter as shown in FIG. 1. The number 85 only conceptualizes continuity of the bladder to the rest of the suit. The rubber bladders 12 and 18 contain a viscid material such as silicone grease 26 which becomes rigid and fixed in shape when confined and under a pressure which is applied to it. A strap 24 is attached to a second rubber bladder 18 which actuates the second rubber bladder by tightening or applying pressure which seals first pleated bellows-like section 14 to second pleated bellows-like section 20 of the rubber suit and thence seals the entire suit 16. The bellows allow a gastight, mechanically strong closure about a point of flexing and the pleated sections above and below the joined bellows allows freedom of motion. The ribs 22 are inflatable neoprene rings which interlock with each other under pressure. Thus, two rubber suit sections are perfectly sealed.

Accordingly, while there have been shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

What is claimed is:

1. A gastight seal for rubber suits which comprises:

a first, male, rubber bladder having a plurality of male outer annular protuberant rings, located about the outer circumference of the suit's male bladder portion, containing a viscid material, attached to a first pleated bellows-like section of a main body of the rubber suit;

a second, female, rubber bladder having a plurality of female inner annular protuberant rings located about the inner circumference of such suit's female bladder portion, containing a viscid material attached to a second pleated bellows-like section of a main body of the rubber suit said male bladder rings and female bladder inner rings sealingly mating with one another as said first bladder is tucked into said second bladder;

a strap or other means attached to said second rubber bladder for applying pressure to the viscid material in the second rubber bladder to stiffen and interlock its annular rings with said annular rings of the first rubber bladder which seals said first pleated bellows-like section to second pleated bellows-like section of the rubber suit.

2. A gastight seal for rubber suits as recited in claim 1 in which said rubber bladders are of a shape which allows interlocking, and contain viscid material which becomes rigid and fixed in shape when a pressure is applied to it.

* * * * *